United States Patent [19]

Rifkin

[11] 3,987,586

[45] Oct. 26, 1976

[54] LOCKING CAM FOR AWNING WINDOWS

[76] Inventor: Morton S. Rifkin, 50 E. 10th Court, Hialeah, Fla. 33012

[22] Filed: Aug. 25, 1975

[21] Appl. No.: 607,349

[52] U.S. Cl. ..... 49/394; 49/255

[51] Int. Cl.[2] ..... E05C 19/02

[58] Field of Search ..... 49/81, 252, 255, 248, 49/394, 371

[56] References Cited

UNITED STATES PATENTS

| | | | |
|---|---|---|---|
| 2,952,882 | 9/1960 | Reynand | 49/252 X |
| 3,230,586 | 1/1966 | Smith et al. | 49/81 |
| 3,444,648 | 5/1969 | Anderson et al. | 49/248 |

*Primary Examiner*—Kenneth Downey
*Attorney, Agent, or Firm*—Salvatore G. Militana

[57] ABSTRACT

A locking cam plate for awning windows having a flat body portion adapted to be secured to the side wall frame of the awning window, slots formed on the body portion for pivotal and swinging movement of links connected to the awning window, an open slot formed on the forward edge portion of the body portion for receiving a locking pin mounted on the vent, the open slot forming a lip portion engaged by the locking pin when the vent is in a locked position and wall means connecting the lip portion and the body portion for strengthening the lip portion whereby the vent is prevented from being forcibly opened without actuating the operator.

2 Claims, 9 Drawing Figures

LOCKING CAM FOR AWNING WINDOWS

BACKGROUND OF THE INVENTION

1. Field Of The Invention

This invention relates to awning windows and is more particularly directed to a locking cam plate which locks the awning window when the vents are brought to their closed position.

2. Description Of The Prior Art

Conventional awning windows are provided with locking cams which automatically lock the vents upon bringing the vents first to a closed position when the locking pins mounted on each side of the vents enter a slot formed on the locking cam and upon the continued actuation of the operator, the locking pin slides upwardly and is retained behind a lip formed on the locking cams. However, the locking cams have been found inadequate to prevent a person from opening the vent by applying a force on the outside of the vents. The failure of the locking cams are due to a lack of sufficient strength and rigidity to prevent the locking pins from rupturing the lips or causing them to bend out of the path of locking pins so as to permit locking pin to by-pass the locking cam and the vent brought to an open position. In view of the large number of burglaries effected by forcing open awning windows, the building codes, local laws, etc. require that the awning windows must withstand a direct outward pulling force on the vents of 150 pounds and a side pull of 75 pounds. The present invention contemplates avoiding the weaknesses of the present cam plates by providing cam plates capable of maintaining the vents in a closed and locked position in compliance with the code requirements.

SUMMARY OF THE INVENTION

Therefore, a principal object of the present invention is to provide awning windows with locking cam plates that are engaged by locking pins mounted on the vents locking the windows that require the actuation of the operator in order to bring the vents to their open position.

Another object of the present invention is to provide awning windows with locking cam plates which prevent any forcible opening of the vents by use of an outwide force that would either rupture the cam plate or bend it out of the path of locking pins mounted on the vents.

A further object of the present invention is to provide awning windows with locking cam plates having a sufficiently strong lip portion that will not break or bend when an outside force if applied to the vent to open same.

A still further object of the present invention is to provide an awning window with cam plates having a lip portion strengthened by a web portion extending between the lip portion and the body of the cam plate to prevent rupture and bending of the lip portion when a force is applied on the outside of the vents when an attempt is made to forcibly open the vents without actuating the operating handle.

With these and other objects in view, the invention will be best understood from a consideration of the following detailed description taken in connection with the accompanying drawings forming a part of this specification, with the understanding, however, that the invention is not confined to any strict conformity with the showing of the drawings but may be changed or modified so long as such changes or modifications mark no material departure from the salient features of the invention as expressed in the appended claims.

BRIEF DESCRIPTION OF THE DRAWINGS

In the drawings.

Referring to the drawings wherein like numerals are used to designate similar parts throughout the several views, the numeral 10 refers to an awning window which is conventional in construction and operation except for the locking cam plates 30 which are explained in detail hereinafter.

Figure 1:
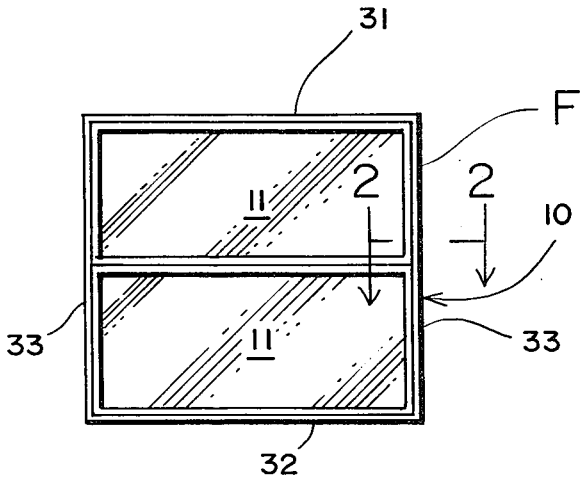
FIG. 1 is a front elevational view of an awning window having my locking cams mounted thereon.
Figure 2:
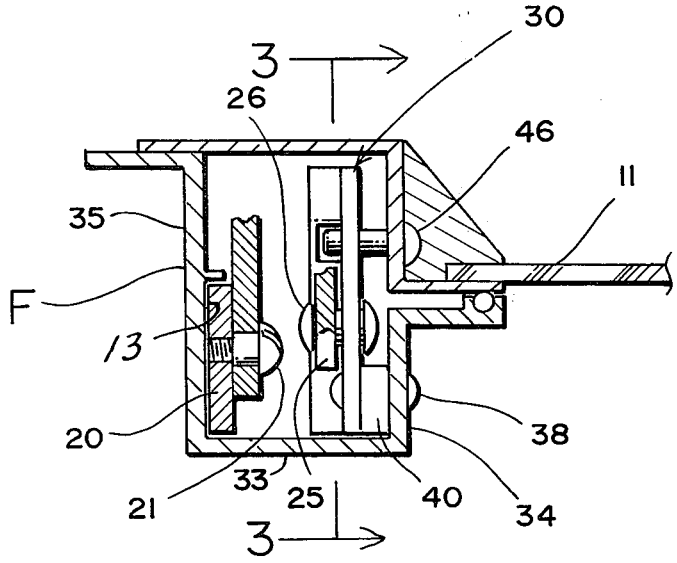
FIG. 2 is a cross sectional view taken along the line 2—2 of FIG. 1.
Figures 6, 7, 8, 9:
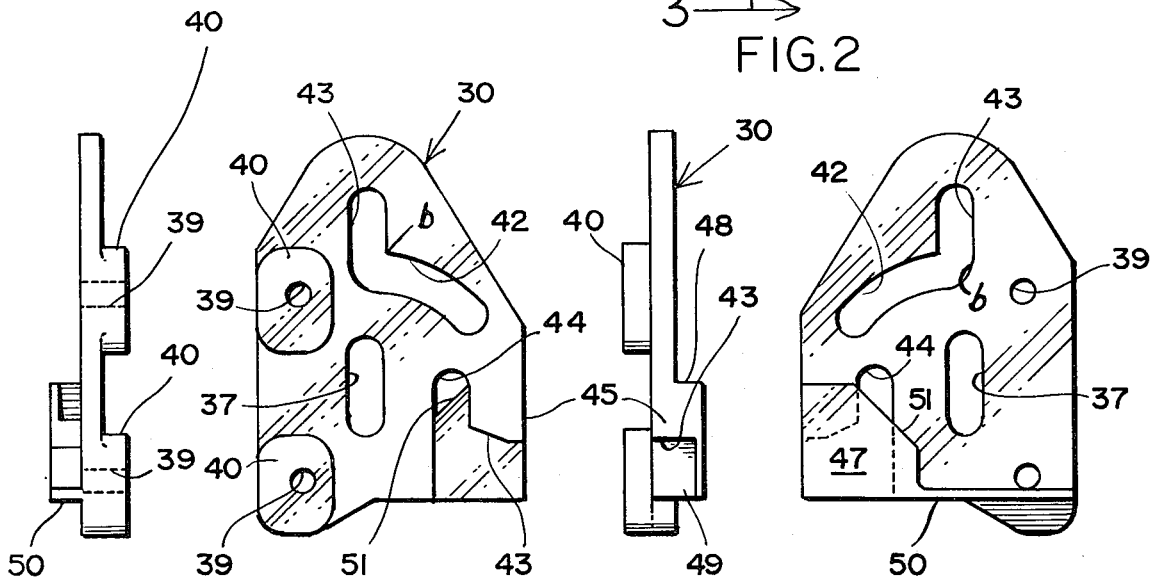
FIG. 6 is a front plan view of my locking cam.
FIG. 7 is a similar view of the obverse side.
FIGS. 8 and 9 are side edge views thereof.

The awning window 10 consists of a plurality of vents 11 mounted for vertical swinging movement from closed to open positions and vice-versa by means of an operator 12 mounted on the vent frame F.

The vent frame F consists of a header 31, sill 32 and vertically disposed side frames 33 having a U cross sectional shape. The side frame members 33 are each provided with an inner leg portion 34 and an outer leg portion 35 both extending at right angle to the side frame 33 and against which the vents 11 bear when in a closed position.

The operator 12 is connected by conventional gear system (not shown) connected to a cross shaft 15 that rotatably extends between the outer side leg portions 35 adjacent the bottom frame member or sill 32. At each end of the cross shaft 15 adjacent the leg portions 35 is a shaft lever 16 secured thereto at one end and pivotally mounted as at 17 to the lower end of a link 18 whose other end is pivoted by a pivot pin 19 mounted on a slide bar 20. The slide bars 20 are positioned to slide vertically in channels 13 along the inner side of the outer leg portions 35 upon actuation of the operator 12.

Each of the vents 11 are pivotally connected to the slide bars 20 by means of a pivot pin 21 extending through hinge plates 22 extending beyond the top portion of the vents 11. Each vent 11 is provided with a locking pin 46 mounted on each side thereof and extending toward the side frames 33. Pivotally secured as at 23 to each of the side vent frame members 24 is a vent link 25 whose lower end is provided with a pivot pin 26 which is pivotally and slidably positioned in an elongated opening 37 in a lock cam plate 30, the subject matter of applicant's invention.

The cam plate 30 of which there are two in number for each vent 11 is secured to the inner side leg portions 34 by means of rivets 38 extending through openings 39 formed in the center of a raised surface portion 40 which bear against the inner leg portion 34 of the vertical side frame 33. Adjacent to the pivot pin 26 on the vent link 25 is a second pin 27 mounted thereon received by an arcuate slot 42. The latter extends to and communicates with a vertical slot 43 that is in vertical alignment with the elongated slot 37 and of equal length with that of the slot 37. At the forward and bottom edge portions of the cam plate 30 is an opening 43 whose inner end portion communicates with a vertically disposed slot 44 thereby forming a lip portion 45. At the position of the opening 43 of the cam plate there are provided raised surfaces 48 and 49 at the lip 45 and the lower portion of the cam plate 30 with a wall 47 connecting the lip 45 to the main body of the cam plate 30 thereby strengthening the lip 45 against tearing, breaking or bending, as explained in detail hereinafter. Extending along the bottom edge of the cam plate 30 is a ledge 50. The wall 47 is truncated as at 51 to form a stop for the vent link 18 when the vent 11 is in its completely open position. The ledge 50 and the wall 47 are coplanar to permit space alongside the cam plate 30 for the pivoting movements of the vent link 25. When the vents 11 have swung to their closed positions, lock pin 46 mounted on each side of the vent 11 and extending toward the side frames 33 will be received at the opening 43 directly below the slot 44.

Figures 3, 4, 5:
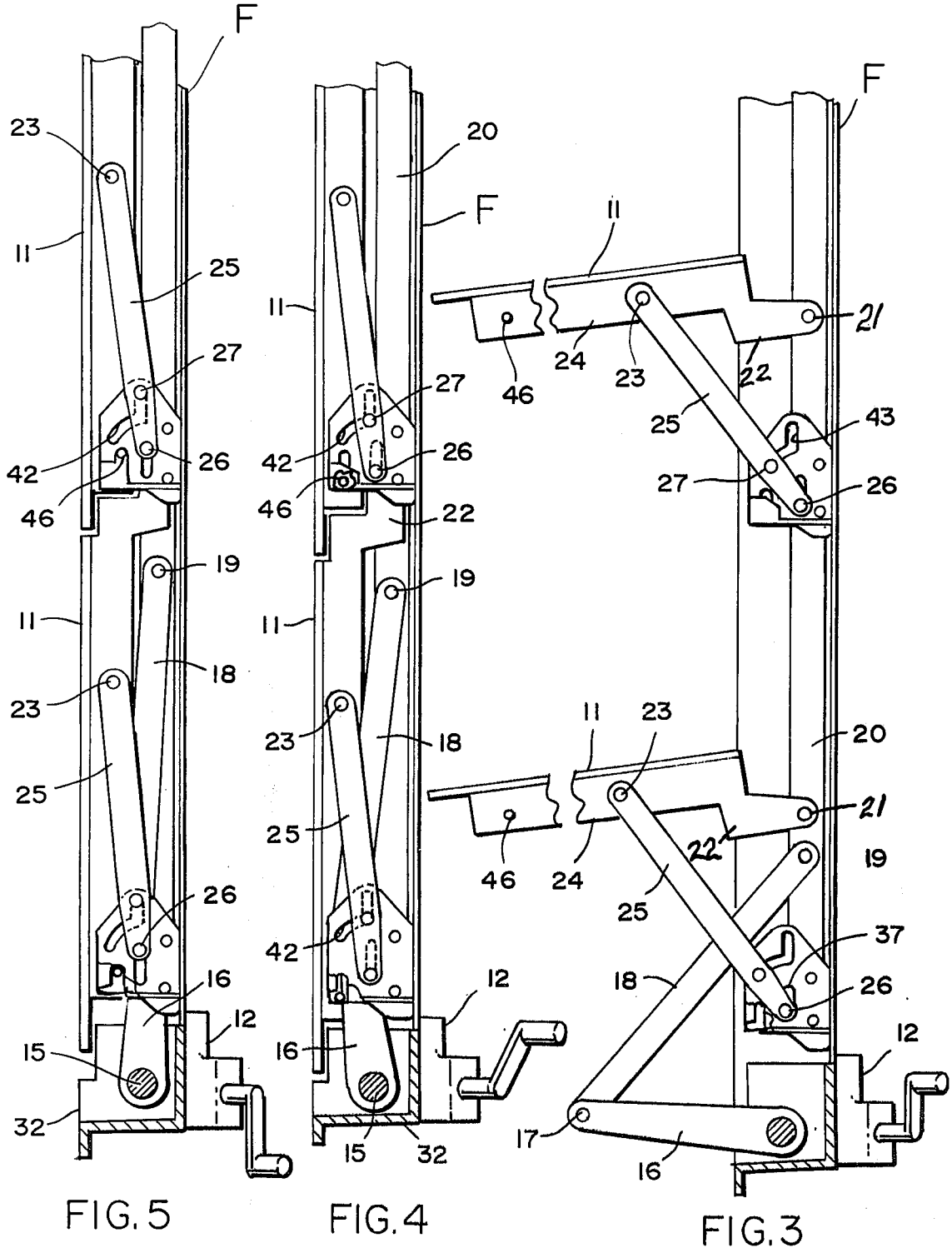
FIG. 3 is a cross sectional view taken along the line 3—3 of FIG. 2 with the vents shown in an open position.
FIG. 4 is a similar view with the vents shown in a closed position.
FIG. 5 is a similar view with the vents shown in a locked position.

At this position of the vents 11, the vent links 25 will extend vertically as shown by FIG. 4, and the pin 27 will be positioned at position *b*, the juncture of the arcuate slot 42 and vertical slot 43 of the cam plates 30. At this position, the vents 11 are in a closed by unlocked position. Further actuation of the operator 12 will cause the slide bar 20 to slide upwardly carrying with it the vents 11. This causes the pins 27, 26 and 46 to slide upwardly in the slots 43, 37 and 44 respectively, thereby placing the vents 11 in their closed and locked positions.

In order to open the vents 11, the operator 12 must be actuated to slide the slide bar 20 in a downward direction to cause the vent links 25 and vents 11 to slide vertically in a downward direction to the closed and unlocked position wherein the pins 27, 26 and 46 had slid downwardly in their respective slots 43, 37 and 44. Now further actuation of the operator 12 will cause the vents 11 to swing to their open position.

When the vents 11 are in their closed and locked positions, the locking pins 46 of the vents 11 will be found in the slots 44 of the locking cam plates 30. The lip 45 of the cam plates 30 prevents the locking pins 46 from any swinging movement of the vents 11 until the pins 46 are slid downwardly in the slot 44 and become free of the lip 45. In addition to strengthening the lip 45 the wall 47 forms a barrier against side-wise movement of the vents 11. A person may attempt to force the vent 11 to become unlocked by wedging a tool at one side of the vent 11 to cause the locking pin 46 at the other side to slide side ways and free itself of the lip 45. However, the side wall 47 of the cam plate 30 will be engaged by the locking pin 46 to prevent any side-wise movements of the vent 11. Consequently any attempt to forcibly swing the vents 11 from the locked position to an open position without first actuating the operator 12 is thwarted.

What I claim as new and desire to secure by Letters Patent is:

1. A locking cam plate for awning windows having outwardly swinging vents, comprising a substantially flat body portion, a substantially elongated slotted portion mounted on said body portion for receiving a vent link pivot pin, an open slotted portion extending from an edge portion of said body portion for receiving a locking pin mounted on said vent when said vent is swung to a closed position, a further slotted portion communicating with said open slotted portion mounted in substantially parallel relation with said elongated slotted portion for receiving said locking pin upon the vent arriving at its locked position, said further slotted portion forming a lip portion adapted to engage said locking pin to prevent the swinging of said vent to an open position and bridge means joining said lip portion and said body portion extending over and in substantially spaced relation to said slotted portion for strengthening said lip portion.

2. The structure as recited by claim 1 wherein said bridge means comprises a wall portion extending from said lip portion to said body portion adjacent said further slotted portion and raised surface means connecting said wall portion in substantially parallel and spaced relation to said body portion and a ledge portion extending from said wall portion along said main body portion for further strengthening said lip portion.

* * * * *